United States Patent [19]

Witcombe

[11] Patent Number: 4,761,076

[45] Date of Patent: Aug. 2, 1988

[54] MIXER

[76] Inventor: John D. Witcombe, 8, Swinley Chase, Wilmslow, Cheshire, England

[21] Appl. No.: 741,362

[22] Filed: Jun. 5, 1985

[30] Foreign Application Priority Data

Jul. 3, 1984 [GB] United Kingdom ..... 8416863

[51] Int. Cl.[4] ..... B28C 7/16

[52] U.S. Cl. ..... 366/46; 366/50; 366/64; 366/185; 366/261; 366/289; 366/322

[58] Field of Search ..... 366/45–48, 366/50, 64–67, 96–98, 129, 130, 185, 194, 199–204, 244, 255, 256, 259, 289, 287, 261, 266, 279, 285, 281, 318, 322, 331, 332, 342, 343

[56] References Cited

U.S. PATENT DOCUMENTS

| | | | |
|---|---|---|---|
| 859,943 | 7/1907 | Holden | 366/281 X |
| 1,604,616 | 10/1926 | Strietmann | 366/46 |
| 2,131,290 | 9/1938 | Kochner et al. | 366/201 |
| 2,534,683 | 12/1950 | Schmidt et al. | 366/200 X |
| 3,722,835 | 3/1973 | Knott . | |
| 3,856,273 | 12/1974 | Born | 366/261 |
| 4,340,310 | 7/1982 | Clark | 366/261 |

FOREIGN PATENT DOCUMENTS

| | | |
|---|---|---|
| 256875 | 5/1963 | Australia . |
| 412701 | 7/1968 | Australia . |
| 477051 | 6/1976 | Australia . |

*Primary Examiner*—Timothy F. Simone
*Attorney, Agent, or Firm*—Oblon, Fisher, Spivak, McClelland & Maier

[57] ABSTRACT

There is provided a mixer especially suitable for small batches of cementitious product comprising a receptacle and means for mounting a motor drivable paddle arrangement within the receptacle in such a manner that the paddle, while operating, can be moved manually to sweep substantially the entire volume of said receptacle.

In preferred arrangement the paddle arrangement is powered by a portable electric drilling machine.

13 Claims, 3 Drawing Sheets

MIXER

FIELD OF THE INVENTION

This invention concerns a mixer particularly, though by no means exclusively, suitable for the mixing of cementitious products and especially small batches thereof and as such attractive to both the do-it-yourself enthusiast or the professional with a small job on hand.

DESCRIPTION OF THE RELATED ART

Cement mixing, especially when done thoroughly, is quite labour intensive and usually necessitates a substantial cleaning operation on completion regardless of the paucity of the quantity of mix prepared.

Although small capacity motor-driven cement mixers are available they are quite costly and bulky to store. For these reasons the do-it-yourself enthusiast will generally prefer to mix his cement by hand or to hire a mixer when required. This latter can prove expensive since the average do-it-yourself project may extend over a number of weekends necessitating several separate hirings.

Typical of prior art cement and like material mixers is one shown in U.S. Pat. No. 1,604,616, which comprises a wheeled cart with a paddle rotatable about a horizontal axis, the paddle extending from side to side of the cart. The paddle is rotated by a hand crank.

Other mixers, typical of the food mixer art, employ paddles rotatable about a vertical axis which may be fixed in some designs or orbital in others.

Larger concrete mixers of course use a rotating mixing chamber with internal blades which act as paddles as the chamber rotates, the chamber's axis of rotation being essentially vertical, but tippable so as to facilitate loading of the mix and pouring of the mixed concrete. Even if scaled down, this design would be expensive to produce.

It is an object of the present invention to provide a mixer suitable for production of small batches of cementitious material and which is of simple construction yet effective in operation.

SUMMARY OF THE INVENTION

According to the present invention there is provided a mixer comprising an open-topped mixing receptacle and means for mounting a motor drivable paddle arrangement within the receptacle in such a manner that the paddle, whilst operating, can be moved manually to sweep substantially the entire volume of said receptacle.

The receptacle may be of substantially quarter-circle shaped cross-section.

The paddle arrangement may have a drive shaft removably connectable with the chuck of a portable electric drill, either directly or by way of an intermediate part.

The receptacle may be equipped with wheels and handle to serve as a barrow for collecting ingredients for the mix from spaced locations and delivering the mix to a desired position.

Although it is anticipated that the design of paddle arrangement may take many different forms, tests have shown that an arrangement which splits the materials of the mix and conveys them upwardly through the height of material within the receptacle to means which deflect them downwardly is particularly efficacious.

The invention will be further apparent from the following description, with reference to the several figures of the accompanying drawings, which show, by way of example only, one form of cement mixer embodying the invention.

DESCRIPTION OF THE PREFERRED EMBODIMENT

Figure 1:
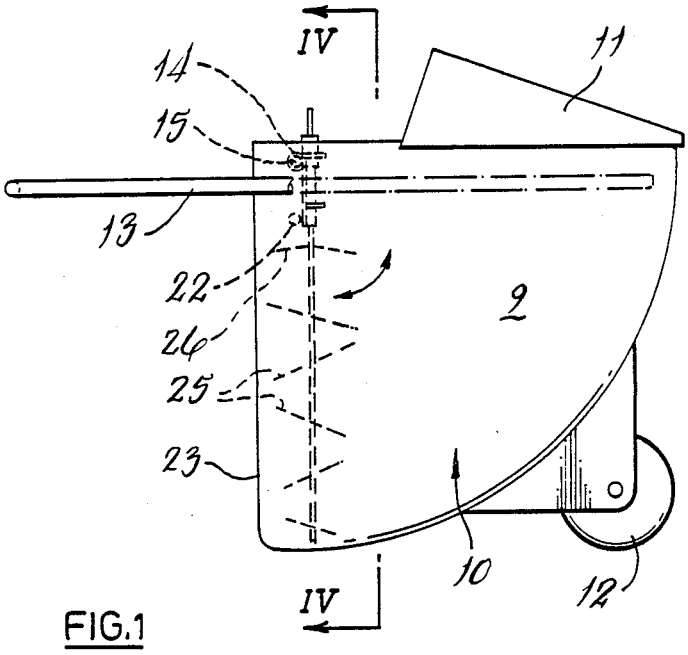
FIG. 1 shows a side elevation of the mixer.
Figure 2:
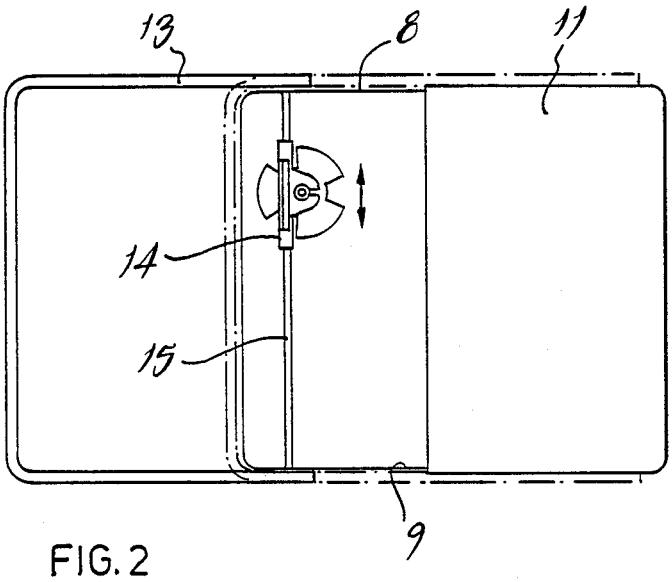
FIG. 2 shows a plan view of the mixer.
Figure 3:
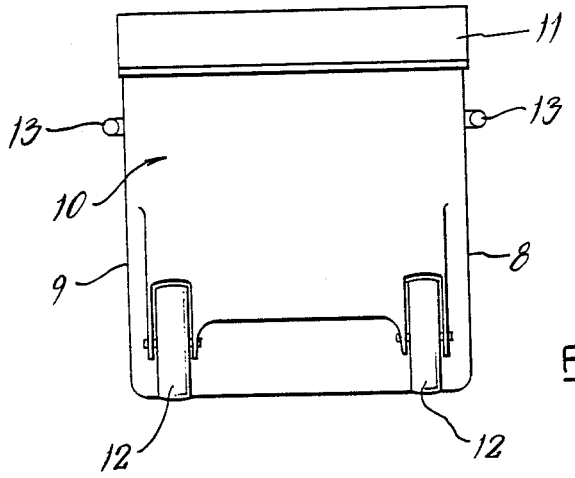
FIG. 3 shows a front elevation of the mixer.
Figure 4:
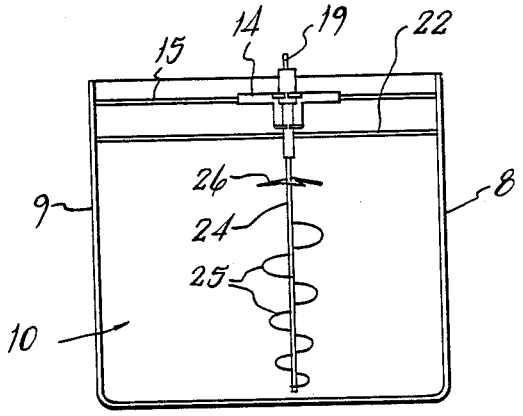
FIG. 4 shows a cross-section of the mixer on the line IV—IV of FIG. 1.

Referring now to the drawings, it will be seen that the mixer essentially comprises an open-topped mixing receptacle 10 which is adapted to support a removable clip-on lid 11 to cover its forward portion.

The receptacle which may be a plastics moulding has a substantially quarter circle shaped cross-section when seen from the side— for a purpose which will be apparent hereinafter— and is equipped with wheels 12 at its lower forward edge and a handle 13 slidable between a stowed position shown in chain dotted lines and an operative position shown in full lines to enable it to serve as a small barrow.

A support member 14 is pivotally and slidably mounted on a shaft 15 extending between opposite side walls 8 and 9 of the receptacle. The shaft 15 is coincident with the centre of the quarter circle shaped cross-section of the receptacle 10. The member 14 carries slotted lugs 16 forming seats adapted to removably receive axially spaced conical surfaces 17 on a bearing tube 18 in which a drive shaft 19 for a paddle arrangement to be discussed hereinafter can rotate but is held against axial displacement.

A pin 20 extends radially through the drive shaft 19 adjacent the upper end thereof to enable a driving connection with a conventional portable electric drilling machine having a bayonet socket like accessory 21 fitted into its chuck. The drilling machine is used to power the mixer when desired. It will be understood that in general it will only be possible to form the driving connection when the paddle arrangement is properly mounted in the receptacle— a valuable safety feature. A permanently fitted motor drive is however a possible, albeit more costly, alternative to the portable drilling machine.

The arrangement is such that the handle of the drilling machine may be used, with the motor running, to move the paddle arrangement by sliding and pivoting of the support member 14 relative to the shaft 15 to sweep substantially the entire internal volume of the receptacle 10. The support member 14 extends outwardly to either side of the paddle arrangement and acts as stop means against side walls 8 and 9, and a stop bar 22 below the shaft 15 prevents excessive rotation of the paddle arrangement towards the rear wall 23 of the receptacle, all whereby engagement of the paddle with the walls of the receptacle is prevented.

Figure 5:
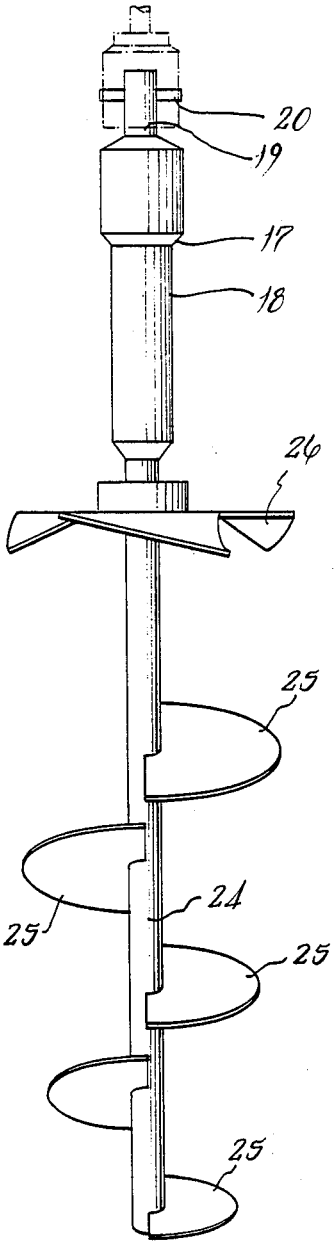
FIG. 5 shows a perspective view of the removable paddle arrangement.

As best seen from FIG. 5, the paddle arrangement, which may be fabricated from metal or in the form of a metal diecasting or plastic moulding comprises a shaft 24 which extends downwardly from shaft 19 or which is an integral extension thereof carrying a plurality of lower blades 25 each of half circle shape. Successive blades 25 are disposed on opposite sides of shaft 24 and are upwardly inclined from the axis of the shaft. The shaft 24 also carries an uppermost blade 26 comprising a plurality of radially extending leaves each angled downwardly. The envelope of the paddle arrangement has a shape substantially corresponding with the shape of the corners of the receptacle and the length of the paddle arrangement from shaft 15 to its lower end is substantially equal to the radius of the quarter circle shape of the receptacle.

In operation the blades 25 serve to lift and split the material whilst the blade 26 redirects it downwardly.

In use, the receptacle— being used in the fashion of a barrow— may be wheeled to a sand supply and loaded to capacity— two bucketsful or thereabouts cement and water may then be added in desired proportions with any required aggregate and the paddle arrangement fitted and operated as previously described. It will be found that an excellent mix is rapidly achieved with little effort, whereafter the paddle arrangement is removed and the mix wheeled to its locality of use.

It will be appreciated that it is not intended to limit the invention to the above example only, many variations, such as might readily occur to one skilled in the art, being possible, without departing from the scope thereof, as defined by the appended claims.

Thus, for example, the receptacle may be of half-circle shape with the shaft supporting the paddle arrangement located at the centre of the upper side thereof.

I claim:

1. A mixer adapted for connection to a driving arrangement and comprising an open topped mixing receptacle having a part circular-cylindrical cross-section having an angular extent and a center of curvature proximate the open top of the receptacle, a pivot axis extending end-to-end thereof and lying on the center of curvature of the receptacle, pivoting rotary paddle means on said pivot axis pivotable substantially over the angular extend of the cross-section and movable axially of said pivot axis so as to be moveable end-to-end thereof, said paddle means extending from said pivot axis substantially to the circumference of said part-cylindrical cross-section, and said paddle means having means for connection to said driving arrangement for driving the same in rotation for mixing material in the receptacle and means for moving the paddle means pivotally and axially of the pivot axis so as to enable the entire volume of the receptacle to be swept by the rotating paddle means.

2. A mixer according to claim 1 wherein said receptacle is of part-circular cross-section when seen from the side.

3. A mixer according to claim 2 wherein said receptacle is of substantially quarter-circle cross-section when seen from the side.

4. A mixer according to claim 2 wherein the receptacle includes opposite side walls, there being a shaft extending from one side wall of the receptacle to the other and coincident with the centre of the part-circular section of the receptacle, and a support member for said paddle arrangement slidably and pivotally mounted on said shaft.

5. A mixer according to claim 3 wherein the receptacle includes opposite side walls and a back wall, there being a shaft extending from one side wall of the receptacle to the other and coincident with the centre of the part-circular section of the receptacle, and a support member for said paddle arrangement slidably and pivotally mounted on said shaft.

6. A mixer according to claim 1 wherein said paddle arrangement comprises a shaft carrying a plurality of blades thereon.

7. A mixer according to claim 6 wherein there are a plurality of axially spaced lower blades alternately disposed on opposite sides of the shaft, each being of half-circle shape and upwardly inclined from the axis of the shaft and an upper blade comprising a plurality of radially extending leaves each angled downwardly.

8. A mixer according to claim 1 wherein the shaft of said paddle arrangement is adapted for connection with a portable electric drilling machine.

9. A mixer according to claim 8 wherein the shaft of said paddle arrangement has a radially directed pin extending therethrough adjacent its upper end for engagement with a bayonet-socket like accessory which can be secured in the drill chuck.

10. A mixer according to claim 4 wherein said support member extends laterally beyond the envelope of the paddle arrangement to be engageable with the side walls of the receptacle and act as a stop to prevent contact between the paddle arrangement and said side walls.

11. A mixer according to claim 5 including means to limit pivotting movement of said support member to prevent contact between the paddle arrangement and back wall of the receptacle.

12. A mixer according to claim 1 wherein a removable cover is provided for part of the top of the receptacle.

13. A mixer according to claim 1 wherein the receptacle is mounted on wheels and provided with a handle.

* * * * *